United States Patent [19]

Kunzli

[11] Patent Number: 4,575,613

[45] Date of Patent: Mar. 11, 1986

[54] ELECTRICAL STEAM GENERATOR

[75] Inventor: Albert Kunzli, Wiesendangen, Switzerland

[73] Assignee: Sulzer Brothers Limited, Winterthur, Switzerland

[21] Appl. No.: 670,064

[22] Filed: Nov. 9, 1984

[30] Foreign Application Priority Data

Nov. 17, 1983 [CH] Switzerland ..... 6177/83

[51] Int. Cl.[4] ..... H05B 3/60; F22B 1/30

[52] U.S. Cl. ..... 219/284; 219/273; 219/288; 219/289; 219/294; 338/80

[58] Field of Search ..... 219/284–295, 219/271–275; 338/80–86

[56] References Cited

U.S. PATENT DOCUMENTS

| | | | |
|---|---|---|---|
| 4,101,758 | 7/1978 | Sprague | 219/285 |
| 4,109,137 | 8/1978 | Zabelka | 219/285 |
| 4,121,090 | 10/1978 | Kuenzli | 219/294 X |
| 4,169,558 | 10/1979 | Coates | 219/284 X |
| 4,206,342 | 6/1980 | Kuenzli | 219/294 X |

FOREIGN PATENT DOCUMENTS

| | | | |
|---|---|---|---|
| 168622 | 7/1951 | Austria | 219/284 |
| 410256 | 3/1925 | Fed. Rep. of Germany | 219/284 |
| 45088 | 4/1928 | Norway | 219/284 |

*Primary Examiner*—A. Bartis

*Attorney, Agent, or Firm*—Kenyon & Kenyon

[57] ABSTRACT

An electrical steam generator includes a plurality of spaced trays disposed in a vertical axis within a pressure vessel defining a steam generating chamber. Alternate trays are electrically connected to the pressure vessel while the other trays are electrically insulated therefrom. Each tray has an overflow over which sump a film of water flows downwardly into the next lower tray to sump in the vessel below the trays and from which water is pumped to the uppermost tray. The other trays and vessel are connected to an electrical power source. Each tray is provided with a flat horizontally disposed stilling element at the overflow to calm the water in the tray, a perforated vertical water and steam permeable stilling wall upstream of the overflow and a vertical water impermeable shielding wall downstream of and spaced from the overflow. The spacing of the shielding wall provides a gap with a horizontal dimension greater than the maximum expected thickness of the film of water flowing out of the respective tray. The stilling element may be designed to float on the water in the tray.

14 Claims, 4 Drawing Figures

ELECTRICAL STEAM GENERATOR

This invention relates to an electrical steam generator.

As is known, various types of electrical steam or vapor generators have been known for the production of steam. For example, one known steam generator includes a pressure vessel which contains at least two trays, one above the other along a substantially vertical axis. Generally, the alternating trays are electrically insulated from the pressure vessel and are connected to a power supply while the other trays are electrically connected to the pressure vessel. In adddition, means have been provided for pumping water from a sump of the pressure vessel into a top tray so that water may flow downwardly from one tray to the next. To this end, each tray has been provided with an overflow over which a film of water may flow from the upper tray to the next tray and eventually from the bottom tray to the pressure vessel sump.

As is known, the output of such steam generators has been determined by the cross-sectional area of the film of water flowing over the overflow. However, the thickness of this film of water has been limited because, if a certain thickness is exceeded, the water splashes and results in malfunction.

Accordingly, it is an object of the invention to provide an electrical steam or vapour generator in which the thickness of a film of water can be greater than previously known without any water splashing.

It is another object of the invention to provide a steam generator which can be constructed with reduced manufacturing costs per unit output.

It is another object of the invention to be able to control the overflow of water from one tray to another in an electrical steam generator in an efficient manner.

Briefly, the invention provides an electrical steam generator which is constructed of a pressure vessel having a wall defining a chamber and at least two trays for receiving water which are disposed within the vessel along at least one vertical axis. At least one tray is electrically connected to the pressure vessel wall while the other tray is electrically insulated from the pressure vessel while being electrically connected to a power supply. Each tray is also provided with an overflow over which a film of water is able to flow from one tray downwardly into the other tray and from the bottom tray into a sump in the pressure vessel. A means is also provided for pumping water from the sump to the uppermost of the trays.

In accordance with the invention at least one flat stilling element is horizontally disposed in each tray to calm the water in the respective tray. Further, at least one vertical water and steam permeable stilling wall is disposed upstream of the overflow of each tray and extends from a horizontal plane below the overflow to a horizontal plane above the overflow. Still further, at least one vertical water impermeable shielding wall is disposed downstream of the overflow of each tray and extends from a horizontal plane below the overflow to a horizontal plane above the overflow while defining a gap with the tray of a horizontal dimension greater than the maximum expected thickness of the film of water flowing out of the tray.

The flat stilling element calms the water contents of the tray while the stilling wall not only calms the water flowing to the overflow, but also distributes this water satisfactorily along the overflow. The shielding wall prevents harmful effects of any water splashing.

If the water is supplied at the lowest point of the top tray, a considerable improvement in the operational behavior of the generator can be obtained. This is because the resistence produced by the stilling element in the top tray allows a pressure equalization in the water and degasification of the water.

The construction of the generator is relatively simple. Further, the stilling element, stilling wall and shielding wall can be readily applied to existing electrical steam or vapour generators without any need to change the basic construction. Further, the generator can be manufactured in a relatively inexpensive manner using conventional materials.

The stilling element which is used may be a perforate metal sheet which is disposed beneath the overflow of a respective tray. In this case, a very effective and inexpensive structure is provided. Likewise, these advantages can be obtained where the stilling wall is made of a perforate sheet metal.

In order to further simplify the construction of the generator, each shielding wall can be secured to a respective tray. Further, the stilling element and stilling wall of each tray can be interconnected with only one of these being directly secured to a tray near the overflow. This reduces the number of weld seams in the tray and is advantageous in terms of strength.

Each stilling element may be disposed to extend substantially over the entire water contents of a tray upstream of the overflow while the stilling wall extends parallel to the overflow over the entire length of the overflow. These features maximize the effect of the generator.

In very large generators or those which have additional bulky components in the trays, each stilling element, stilling wall and shielding wall may consist of at least two spaced apart overlapping sections.

In order to improve accessibility to the inner zone of the trays for cleaning and overhaul as well as for installation of the generator, each stilling element may consist of at least one hollow member for floating on the water in a tray.

These and other objects and advantages of the invention will become more apparent from the following detailed description taken in conjunction with the accompanying drawings wherein.

Figure 1:
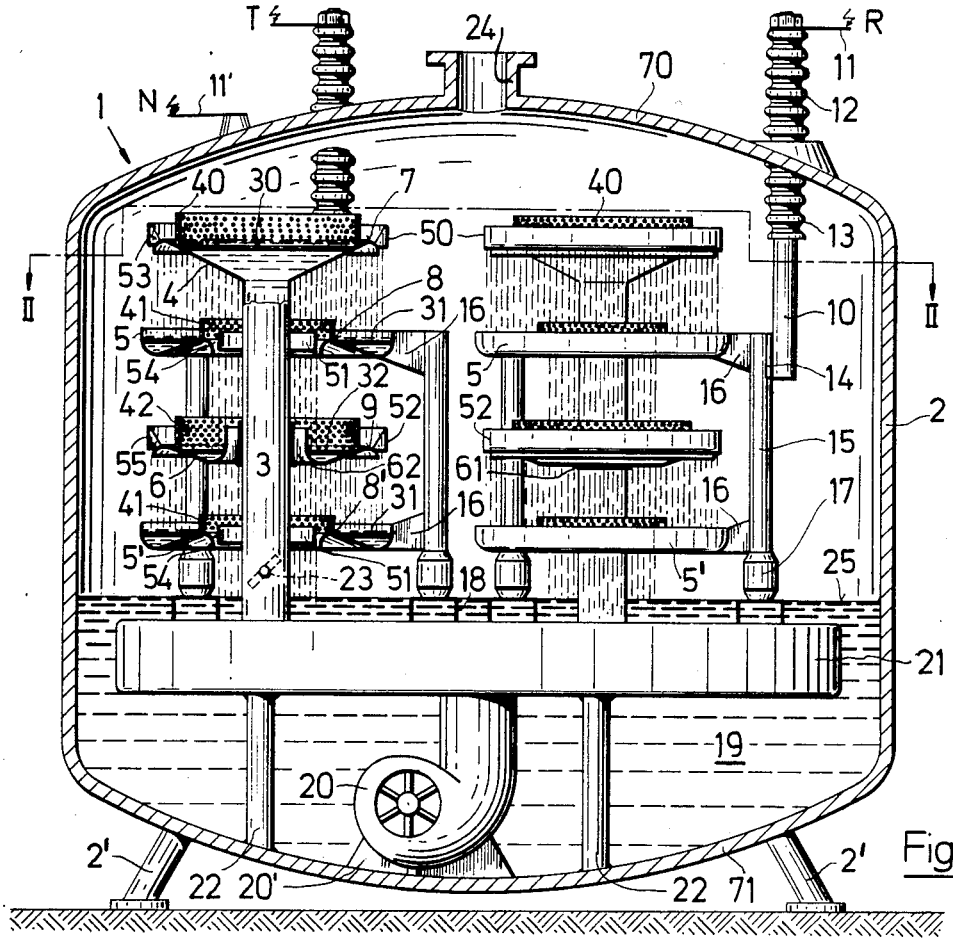
FIG. 1 illustrates a vertical sectional view through an electrical steam generator constructed in accordance with the invention.
Figure 2:
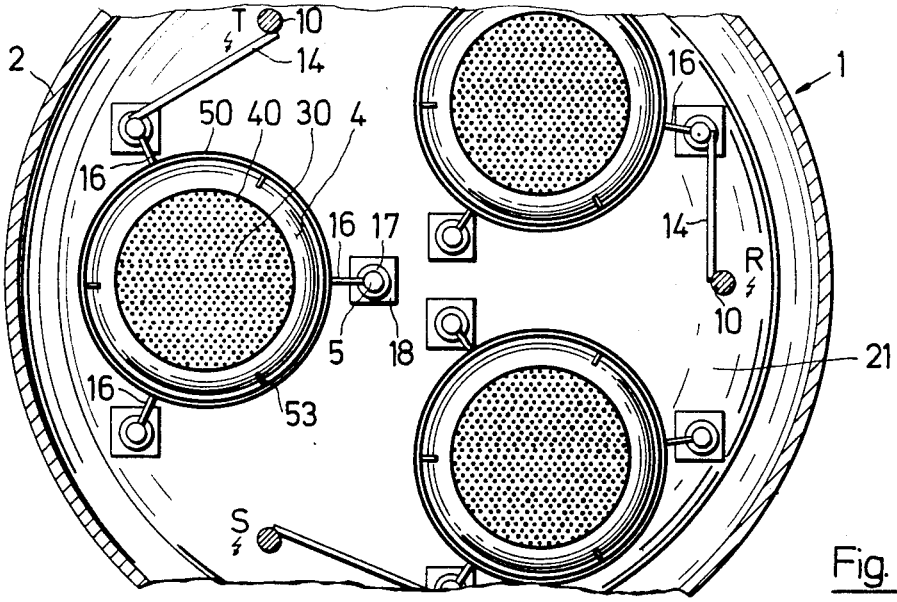
FIG. 2 illustrates a view taken on line II—II of FIG. 1.

Referring to FIGS. 1 and 2, the electrical steam or vapor generator 1 is constructed of a cylindrical pressure vessel 2 which has a circumferential wall defining a chamber. As indicated, the pressure vessel 2 is disposed on a vertical axis and has two outwardly curved ends, i.e. a top end 70 and a bottom end 71. In addition, the vessel 2 is supported on four legs 2' (only two of which are shown for simplicity).

The pressure vessel 2 contains three substantially vertical riser pipes 3 which are arranged in the form of a triangle and which are welded at the bottom in seal-tight relationship to a distributor tank 21 contained in the vessel 2 so as to communicate with the interior of the tank 21. As indicated, the distributor tank 21 is in the form of a short vertical cylinder with two flat ends and rests on the bottom end 71 of the vessel via three tubular supports 22 which are rigidly welded both to the tank 21 and to the end 71. Further, an adjustment valve 23 is provided in each riser pipe 3.

A radial pump 20 is also provided at the bottom end 71 with an intake communicating with the interior of the pressure vessel 2 and a delivery communicating with the interior of the tank 21. This pump 20 is rigidly welded to the bottom end 71 via a sheet-metal plinth 20' and has a rotor (not shown) which is disposed on a horizontal axis of rotation with a rotor shaft (not shown) passing at one end through the wall of the pressure vessel 2. The penetration point of the rotor shaft is sealed in known manner.

The steam generator 1 also has a plurality of trays for receiving water within the pressure vessel 2. As indicated, each riser pipe 3 leads into a tray 4 at the top end which is of inverted frusto-conical shape. To this end, each tray 4 is welded in seal-tight relationship to the riser pipe 3 along the edge of its bottom smaller circular section. The top free edge of each tray 4 is outwardly radiused and forms a horizontal overflow 7 over which a film of water flows.

A ring 61 is secured to each riser pipe 3 at about mid-height and an annular tray 6 surrounding the riser pipe 3 is secured to the ring 61 by means of three radial webs 62. Each annular tray 6 has the cross-section of a horizontal S, the outer radiused edge forming a horizontal overflow 9. The shape and size of this overflow 9 is equal to those of the overflow 7 of the tray 4. As indicated, the inner edge of each annular tray 6 extends vertically and terminates at a higher level or horizontal plane than the overflow 9.

Annular trays 5, 5' are disposed around each riser pipe 3 substantially in the middle between the top tray 4 and the annular tray 6 and between the annular tray 6 and the distributor tank 21. The annular trays 5, 5' are of identical construction and have cross-sections in the form of a horizontal S which, however, is arranged in mirror-image fashion in relation to the annular tray 6. The inner radiused edge of each annular tray 5, 5' forms an overflow 8, 8' while the outer edge extends vertically and terminates at a higher level or horizontal plane than the inner edge. The annular trays 5, 5' are secured to three vertical support rods 15 via radial webs 16. Each rod 15 is, in turn, secured to the distributor tank 21 via an insulator 17 and a support plate 18 bent in the shape of an inverted U.

As indicated in FIG. 1, the trays 4, 5, 6, 5' are disposed along a common vertical axis with alternating trays electrically connected to the pressure vessel wall while the other trays are electrically insulated from the pressure vessel and connected to a power supply, as described below. Further, the overflow of each tray is disposed so that a film of water flows from one tray downwardly into the next tray and eventually from the bottom tray into a sump 19 in the pressure vessel. In this respect, the pump 20 serves as a means for pumping the water from the sump 19 in the pressure vessel. In this respect, the pump 20 serves as a means for pumping the water from the sump 19 to the uppermost tray 4 via the distributor tank 21 and riser pipe 3.

Each tray 4, 5, 5', 6 contains a stilling element 30, 31, 32 each of which consists of a horizontally disposed flat continuous perforate metal sheet below the respective overflows 7, 8, 8', 9. Each of these stilling elements 30, 31, 32 serves to calm the water in the respective trays. In addition, each tray 4, 5, 5', 6 has a vertical water and steam permeable perforate sheet-metal stilling wall 40, 41, 42. Each of these walls forms a cylinder which extends substantially parallel to the respective overflows 7, 8, 8', 9 and each extends from the horizontal plane below the respective overflow to a horizontal plane above the respective overflow. As indicated, in the trays 4, 6, the overflows 7, 9 enclose the stilling walls 40, 42 while in the annular trays 5, 5', the stilling walls 41 enclose the overflows 8, 8'. Both the stilling elements 30, 31, 32 and the stilling walls 40, 41, 42 are rigidly secured to the associated tray by welding.

Each of the trays 4, 6 is also surrounded by a continuous cylindrical and substantially vertical sheet-metal shielding wall 50, 52. As indicated, each shielding wall 50, 52 is disposed downstream of the overflow 7, 9 of the respective trays 4, 6 and extends from a horizontal plane below the overflow to a horizontal plane above the overflow. In like manner, each annular tray 5, 5' surrounds a continuous sheet-metal substantially vertical and cylindrical shielding wall 51 which is likewise downstream of the respective overflow 8, 8'. The shielding walls 50, 51, 52 are each secured to the associated tray be means of three radial webs 53, 54, 55 so that annular gaps are defined between each shielding wall and the respective tray. These gaps are interrupted only by the extremely thin webs 52, 54, 55. In addition, each gap has a horizontal dimension greater than the maximum expected thickness of the film of water to flow of a respective tray.

Referring to FIG. 1, a steam outlet 24 is welded in seal-tight relationship substantially in the center of the top end 70 of the pressure vessel 2 and is connected by a flange to a steam pipe (not shown).

The power supply for the generator employs three power supply rods 10 which extend through the top end 70 of the vessel 2 and which are secured to the vessel 2 via electrical insulation provided by external and internal insulating bushes 12, 13. In addition, a bus bar 11 of a three-phase system comprising phases RST is connected to each power supply rod 10 outside the pressure vessel 2. The pressure vessel 2 is also connected in known manner (not shown) to the neutral conductorn of the three-phase system via a bus bar 11'. Each power supply rod 10 is electrically connected to a respective support rod 15 inside the vessel by a bus bar 14. As indicated in FIGS. 1 and 2, two pairs of trays are disposed on each riser pipe 3, i.e. a top pair formed by the tray 4 and the annular tray 5 and a bottom pair formed by the annular tray 6 and the annular tray 5'. In each pair, the lower annular tray 5, 5' is connected to the three-phase power supply but is electrically insulated from the pressure vessel, whereas the top tray 4 and the annular tray 6 are electrically connected to the pressure vessel. The overflows 7, 9 of the trays 4, 6 of each pair are also at a distance from the riser pipe 3, whereas in the lower annular tray 5, 5', the overflow 8, 8' extends near the riser pipe 3.

The steam generator operates as follows: The pressure vessel 2 is first filled with water via suitable supply means (not shown) to a level 25 between the support plates 18 and the insulators 17. During operation, this level 25 is maintained by control means (not shown) which act on the water supply means. The water space beneath the level 25 forms the sump 19 of the pressure vessel 2.

After filling, the pump 20 is started so that water is fed from the sump 19 to the trays 4 via the distribution tank 21 and the riser pipes 3. In each tray 4, the water flows through the stilling element 30 and the stilling wall 40 to the overflow 7, and flows from there through the gap between the edge of the tray 4 and the shielding wall 50 into the annular tray 5 to form a level. If this level exceeds the height of the overflow 8, the water flows through the stilling wall 41 and through the gap between the wall 51 and the inner edge of the annular tray 5 into the annular tray 6, where a level is also formed. If the level exceeds the overflow 9, the water flows into the annular tray 5' in a similar manner to the water from the tray 4 and then back into the sump 19.

During this time, the current from the three-phase supply is fed via the buses 11 and power supply rods 10 and buses 14 to the support rods 15 and then via the corresponding web 16 to the annular trays 5, 5'. From the latter, the current flows through the falling film of water up to the trays 4 and annular trays 6, and then via the riser pipes 3 to the wall of the pressure vessel 2 and then to the neutral conductor. Each of the three electrode systems has a certain resistance as a result of the free heights of fall of the water between the trays 4 and the annular trays 5 and between the annular trays 6 and the annular trays 5'—these heights being substantially identical—and as a result of the water throughput and the water conductivity. These resistances can be adjusted to one another by adjustment of the valves 23.

The current flow causes the water in the pressure vessel 2 to be initially heated and evaporated if the latter is required and assuming that the water supply and discharge are adjusted accordingly, a required pressure and the associated saturated steam temperature being reached in these conditions. The resulting steam or vapor escapes through the outlet 24.

During operation, the stilling elements 30, 31, 32 and the stilling walls 40, 41, 42 damp any wave formation and any other undesirable water movement in order to ensure still levels and uniform flow with good distribution of the water in each tray 4, 5, 5', 6.

The stilling element 30 in tray 4 additionally provides good pressure distribution of the water fed by the pump 20 from the tank 21, and good separation of air and other gases contained in the water. At the same time, the shielding walls 50, 51 52 prevent water from falling onto the live parts or onto the insulators 17, since this could result in intensive corrosion or undesirable short-circuits. These steps, which are extremely simple both in terms of design and manufacture, enable the thickness of the film of water at the overflows and, hence, the amount of water flowing through the trays to be so increased so that the amount of steam produced is greatly increased in comparison with the known steam generator, this effect being achieved inexpensively.

Figure 3:
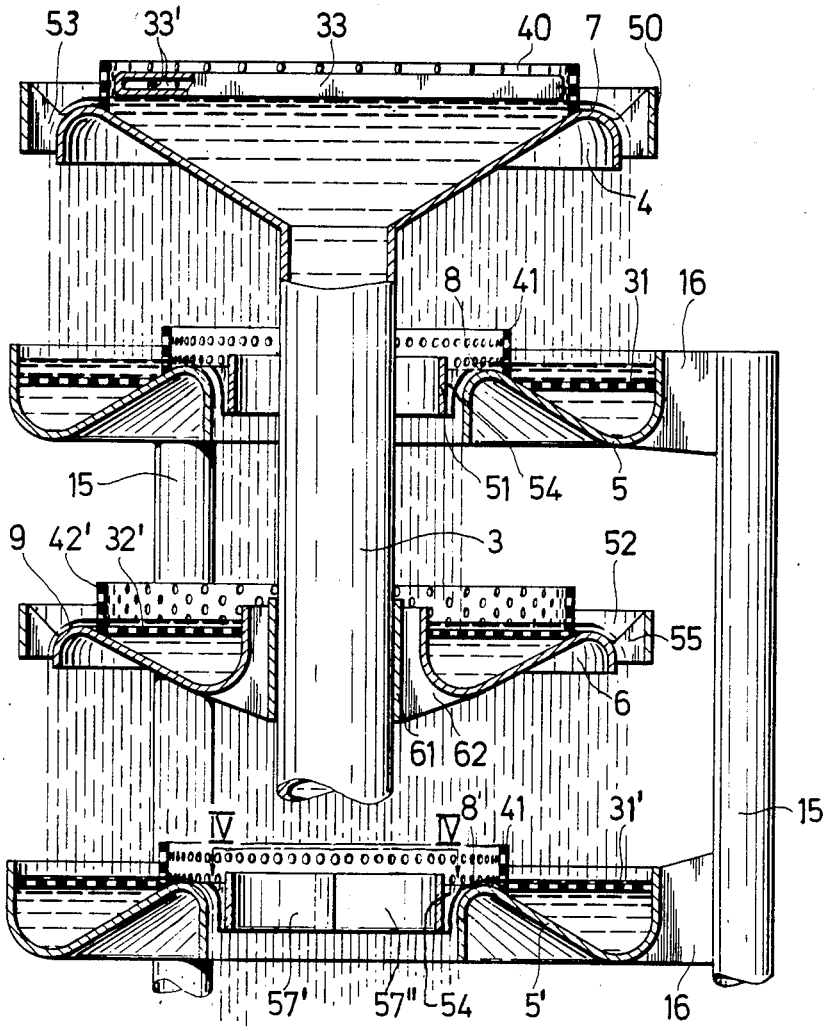
FIG. 3 illustrates a view of a tray arrangement slightly modified from that of FIG. 1 in accordance with the invention.

Referring to FIG. 3, instead of the tray 4 having a perforate sheet as a stilling element, a floating hollow member 33 which is guided laterally on the water surface by the stilling wall 40 may be provided. The hollow member 33 is in the form of a circular sheet-metal disc with reinforcing ribs 33' being provided internally. In this case, any degassing of the water is through the stilling wall 40. Alternatively, the hollow member 33 may, for this purpose, be formed with apertures or the underside may be made slightly conical sloping up towards a passage aperture. The advantage of the hollow member 33 is the ease with which the member 33 can be removed for access to components of the electrical steam generator 1 situated therebeneath. The stilling and pressure-equalizing effect of this stilling element 33 are also good.

The annular tray 5 in FIG. 3 is of identical construction to FIG. 1 so that this illustration simply gives a better view of the construction of the tray 5.

In the annular tray 6 shown in FIG. 3, on the other hand, the stilling element 32' is connected to the stilling wall 42' so that only the stilling element 32' is directly welded to the annular tray 6. Similarly, stilling element 31' of annular tray 5' in FIG. 3 is connected to the stilling wall 41', the latter being directly welded to the annular tray 5'. The annular trays 5', 6 in FIG. 3 thus each have one weld seam less than in the exemplified embodiment according to FIG. 1. This has an advantageous effect on their strength properties.

Figure 4:
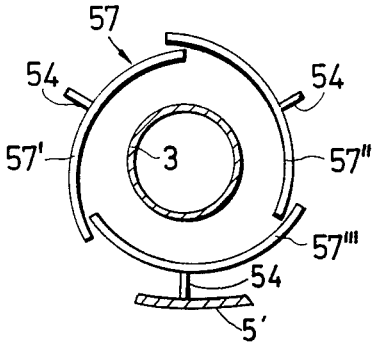
FIG. 4 illustrates a view taken on line IV—IV of FIG. 3.

Instead of the continuous shielding wall 51 for the tray 5' in FIG. 1, the tray 5' in FIG. 3 has a shielding wall consisting of three bent sheet-metal portions 57', 57'', 57''' (FIG. 4) which overlap but which do not touch (i.e. being spaced part), each being connected to the tray 5' via one of the radial webs 54. This construction gives the annular tray 5' some flexibility and reduces material stresses, both during manufacture and, for example, in the event of earthquakes. This embodiment is particularly advantageous for the large electrical steam generators.

Although in the exemplified embodiment illustrated, the stilling elements, the stilling walls and the shielding walls consist of smooth sheet-metal, this is not absolutely essential. These components may consist of corrugated or zig-zag sheet-metal or braided strip or wire material. Plastics, for example may also be used instead of just metallic materials. If plastics are used, the components are secured to the associated trays by mechanical means, e.g. screws and nuts with sealing washers therebetween or press-button type fastenings. In some cases, a flat static mixer element can be used as a stilling element and/or stilling wall.

The basic shapes of the stilling elements, the stilling walls and the shielding walls may also differ from the embodiments illustrated. For example, the stilling element may be conical or curved and the stilling wall and/or the shielding wall be polygonal instead of cylindrical or, if required, even conical.

Also, the stilling element need not extend over the entire cross-section of a tray or annular tray, instead a plurality of such stilling elements may be superposed. Also possible are a number of consecutive shielding walls and/or stilling walls which, if required, extend over only part of the total length of the overflow. The trays need not necessarily be circular.

A slight inclination of the trays and hence of the overflows can prevent the film of water breaking up into droplets at low loads, so that a film of water of adequate thickness flows over the lowest point of each overflow even in the case of very small water flows.

In FIGS. 1 and 3, the bottom edges of the shielding walls always extend above the bottom edges of the adjacent tray or annular tray. This ensures accessibility to these edges to facilitate their repair in the event of any wear.

The invention thus provides an electrical steam or vapor generator which can be operated with increased output capacity in a relatively simple manner.

The invention also provides a means of modifying existing electrical steam generators so as to allow increased output in a simple manner.

What is claimed is:

1. An electrical steam generator comprising a pressure vessel having a wall defining a chamber;

at least two trays for receiving water disposed in a vertical spaced array within said pressure vessel along a vertical axis with alternate trays eletrically connected to said pressure vessel wall and the other trays electrically insulated from said pressure vessel, each tray having an overflow over which a film of water flows from each tray downwardly into the next lower tray and from the bottom tray into a sump in said pressure vessel;

a power supply electrically connected to said other trays and to said pressure vessel;

means for pumping water from said sump in said pressure vessel to the uppermost of said trays;

at least one flat stilling element horizontally disposed in each tray at the overflow to calm the water in said respective tray;

at least one vertical water and steam permeable stilling wall disposed upstream of said overflow of each tray and extending from a horizontal plane below said overflow to a horizontal plane above said overflow; and at least one vertical water impermeable shielding wall disposed downstream of said overflow of each tray and extending from a horizontal plane above said overflow to a horizontal plane below said overflow to define a gap with said tray of a horizontal dimension greater than the maximum expected thickness of the film of water flowing out of said respective tray at the overflow.

2. An electrical steam generator as set forth in claim 1 wherein each stilling element is a perforate metal sheet disposed beneath the overflow water level of the respective tray.

3. An electrical steam generator as set forth in claim 1 wherein each stilling wall consists of perforate sheet metal.

4. An electrical steam generator as set forth in claim 1 wherein each shielding wall is secured to a respective tray.

5. An electrical steam generator as set forth in claim 1 wherein each stilling element and each stilling wall are interconnected and only one of said element and stilling wall is directly secured to a respective tray near said overflow thereof.

6. An electrical steam generator as set forth in claim 1 each stilling element is disposed to extend substantially over the entire water contents of a respective tray situated upstream of said overflow thereof.

7. An electrical steam generator as set forth in claim 1 wherein each stilling wall extends parallel to said overflow of a respective tray and over the entire length thereof.

8. An electrical steam generator as set forth in claim 1 wherein each shielding wall consists of at least two spaced part overlapping sections.

9. An electrical steam generator as set forth in claim 1 wherein each stilling element consists of a hollow member for floating on the water in at least one tray.

10. In an electrical steam generator, the combination comprising a tray for receiving a flow of water and having an overflow at a peripheral edge over which a film of water flows;

a stilling element horizontally disposed in said tray to calm the water in said tray;

a water and steam permeable stilling wall upstream of said overflow and extending from a horizontal plane below said overflow to a horizontal plane above said overflow; and a water impermeable shielding wall downstream of said overflow and extending from a horizontal plane below said overflow to a horizontal plane above said overflow and disposed to define a gap with said tray of a horizontal dimension greater than the maximum expected thickness of the film of water flowing out of said tray.

11. The combination as set forth in claim 10 wherein said stilling wall is fixedly mounted in said tray.

12. The combination as set forth in claim 10 wherein said stilling element is disposed to float within said tray.

13. The combination as set forth in claim 10 wherein said overflow is at an outer periphery of said tray.

14. The combination as set forth in claim 10 wherein said overflow is at an inner periphery of said tray.

* * * * *